US011547225B2

(12) United States Patent
Kim et al.

(10) Patent No.: US 11,547,225 B2
(45) Date of Patent: Jan. 10, 2023

(54) CUP

(71) Applicant: Daishin Securities Co., Ltd., Seoul (KR)

(72) Inventors: Bongchan Kim, Seoul (KR); Daejin Kim, Seoul (KR); Guntae Kim, Seoul (KR); Youngmi Park, Seoul (KR)

(73) Assignee: Daishin Securities Co., Ltd., Seoul (KR)

( * ) Notice: Subject to any disclaimer, the term of this patent is extended or adjusted under 35 U.S.C. 154(b) by 178 days.

(21) Appl. No.: 16/900,566

(22) Filed: Jun. 12, 2020

(65) Prior Publication Data

US 2021/0361096 A1 Nov. 25, 2021

(30) Foreign Application Priority Data

May 22, 2020 (KR) ..... 10-2020-0061816

(51) Int. Cl.
*A47G 19/22* (2006.01)
*B65D 25/28* (2006.01)
(Continued)

(52) U.S. Cl.
CPC ..... *A47G 19/2227* (2013.01); *B65D 25/282* (2013.01); *B65D 25/56* (2013.01); *F21S 9/02* (2013.01); *F21S 9/04* (2013.01); *G08B 7/06* (2013.01); *A47G 2019/225* (2013.01); *A47G 2019/2238* (2013.01);
(Continued)

(58) Field of Classification Search
CPC ..... A47G 19/2227; A47G 2019/2238; A47G 2019/2244; A47G 2019/225; A47G 19/2255; A47G 2200/08; A47G 2200/12; A47G 2200/14; A47G 2200/166; A47G 2200/20; B65D 25/282; B65D 25/56; B65D 2203/12; F21S 9/02; F21S 9/04;
(Continued)

(56) References Cited

U.S. PATENT DOCUMENTS 2,597,522 A * 5/1952 Pierce ..... A47G 19/2227 116/152
5,203,471 A * 4/1993 Widman ..... B44D 3/14 220/759
(Continued)

FOREIGN PATENT DOCUMENTS

JP 01-63464 4/1989
JP 2016002451 1/2016
(Continued)

*Primary Examiner* — Kareen K Thomas
(74) *Attorney, Agent, or Firm* — Radlo & Su

(57) ABSTRACT

There is disclosed a cup comprising a cup body comprising an opening and provided to contain a beverage; and a handle part provided in an outer surface of the cup body and configured to be holdable by a user, wherein the handle part forms a preset angle with respect to an outer surface of the cup body so that the cup body supported by handle part is spaced from a table surface or floor when the handle part in contact with the table surface or floor, and wherein the length or width at which the handle part is formed is provided in a size such that when the handle part contacts with the table surface or floor, an imaginary normal extending from the table surface or floor to the center of gravity of the cup body to pass through the handle part.

13 Claims, 8 Drawing Sheets

(51) Int. Cl.

| | |
|---|---|
| ***B65D 25/56*** | (2006.01) |
| ***F21S 9/02*** | (2006.01) |
| ***F21S 9/04*** | (2006.01) |
| ***G08B 7/06*** | (2006.01) |
| *F21W 131/30* | (2006.01) |
| *F21Y 115/10* | (2016.01) |

(52) U.S. Cl.
CPC .. *A47G 2019/2244* (2013.01); *B65D 2203/12* (2013.01); *F21W 2131/30* (2013.01); *F21Y 2115/10* (2016.08)

(58) Field of Classification Search
CPC ... G08B 7/06; F21W 2131/30; F21Y 2115/10; H02N 2/18
See application file for complete search history.

(56) References Cited

U.S. PATENT DOCUMENTS 5,484,081 A * 1/1996 Jahn ..... A47G 23/0216 220/759
5,671,503 A * 9/1997 Uebelacker ..... B65D 21/0204 220/756
5,739,758 A * 4/1998 Driska ..... A47G 19/2227 220/756
6,037,872 A * 3/2000 Dunnum ..... A61J 9/0607 374/150
6,073,795 A * 6/2000 Longstreth ..... B65D 43/021 220/756
7,581,704 B1 * 9/2009 Pugsley ..... A47G 23/0233 220/756
8,113,378 B2 * 2/2012 Wassmann ..... A47G 19/22 220/703
9,815,319 B2 * 11/2017 Cooper ..... B44D 3/14
10,213,032 B1 * 2/2019 Fontaine-Cole ... B65D 25/2811
2006/0076260 A1 * 4/2006 Luburic ..... B65D 47/0842 206/503
2008/0277020 A1 * 11/2008 Windmiller ..... B67D 1/0805 220/756
2013/0240551 A1 * 9/2013 Peacock ..... A47G 19/2205 220/766
2014/0265382 A1 * 9/2014 Bajuyo ..... A45F 5/102 294/15
2015/0157150 A1 * 6/2015 Ash ..... A47G 23/0306 206/457
2016/0229591 A1 * 8/2016 Bajuyo ..... B65D 25/2888
2019/0014894 A1 * 1/2019 Hancock ..... A45F 5/10
2019/0254450 A1 * 8/2019 Koizumi ..... A47G 19/22
2021/0053726 A1 * 2/2021 Hasani ..... A47G 19/2205

FOREIGN PATENT DOCUMENTS

| | | |
|---|---|---|
| JP | 3224423 | 12/2019 |
| KR | 20020056885 | 7/2002 |
| KR | 20-2013-0005172 | 8/2013 |
| KR | 20200051982 | 5/2020 |

* cited by examiner

[FIG 1]
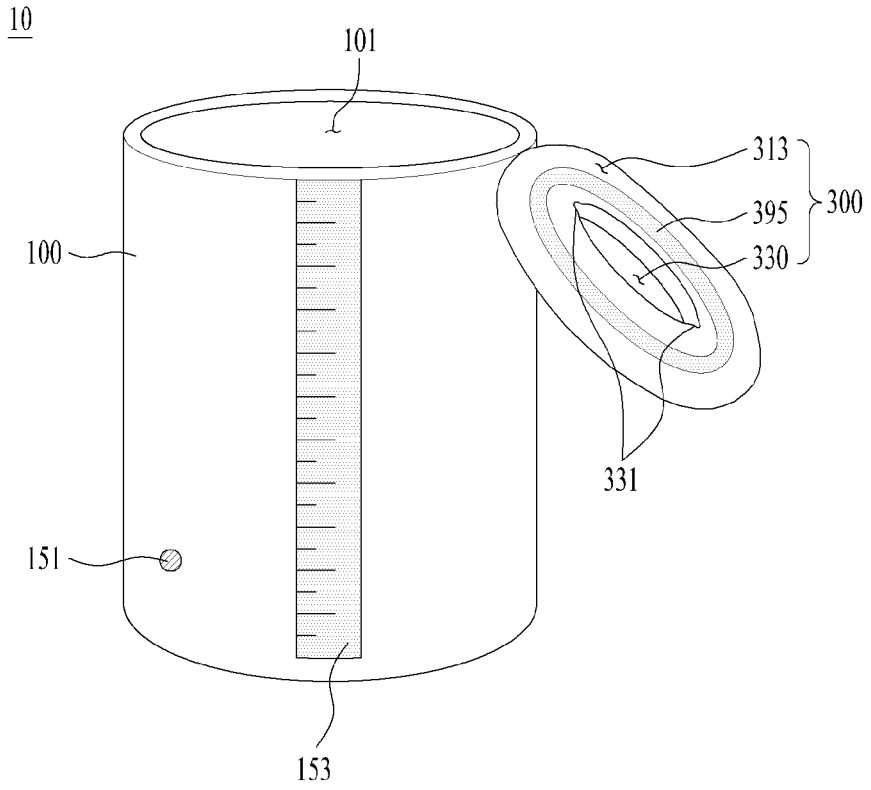

[FIG 2]
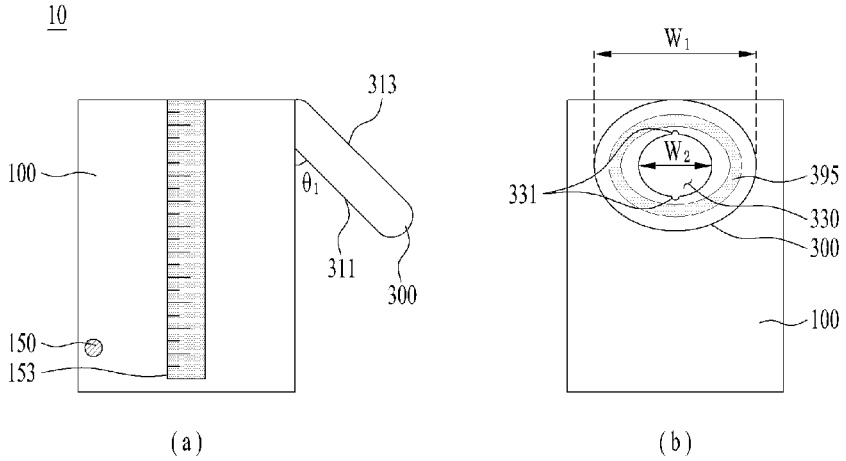

[FIG 3]
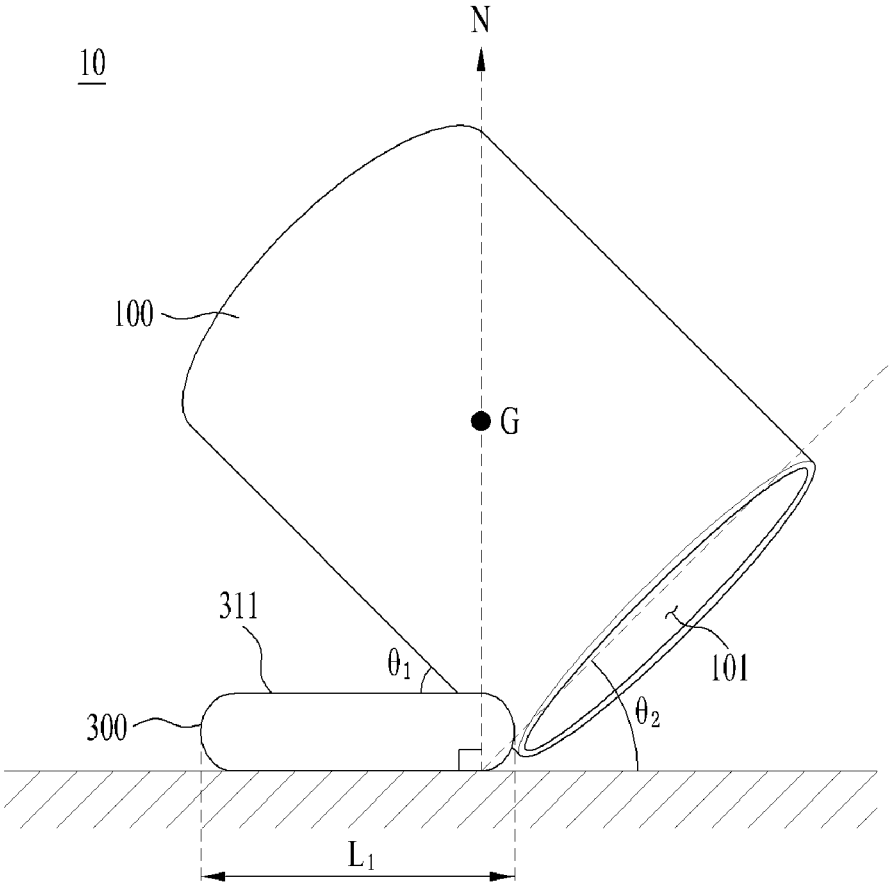

[FIG 4]
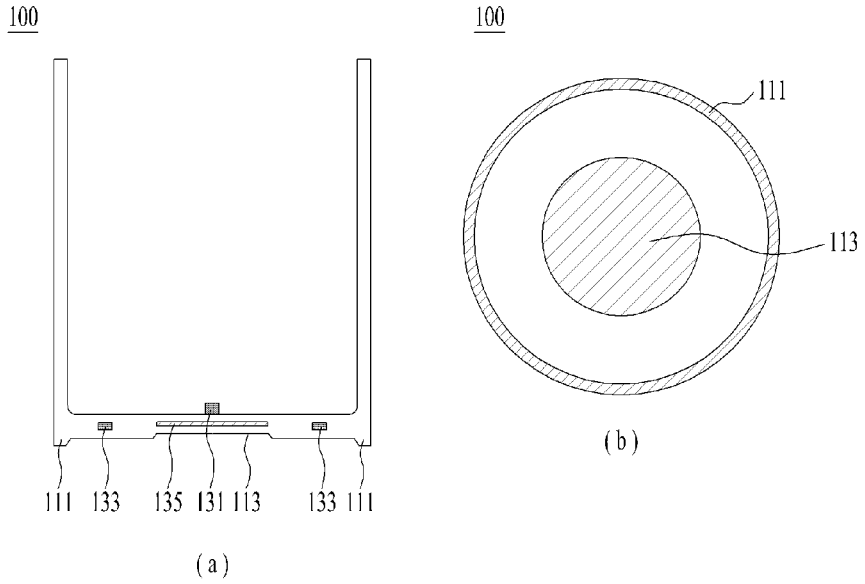

[FIG 5]
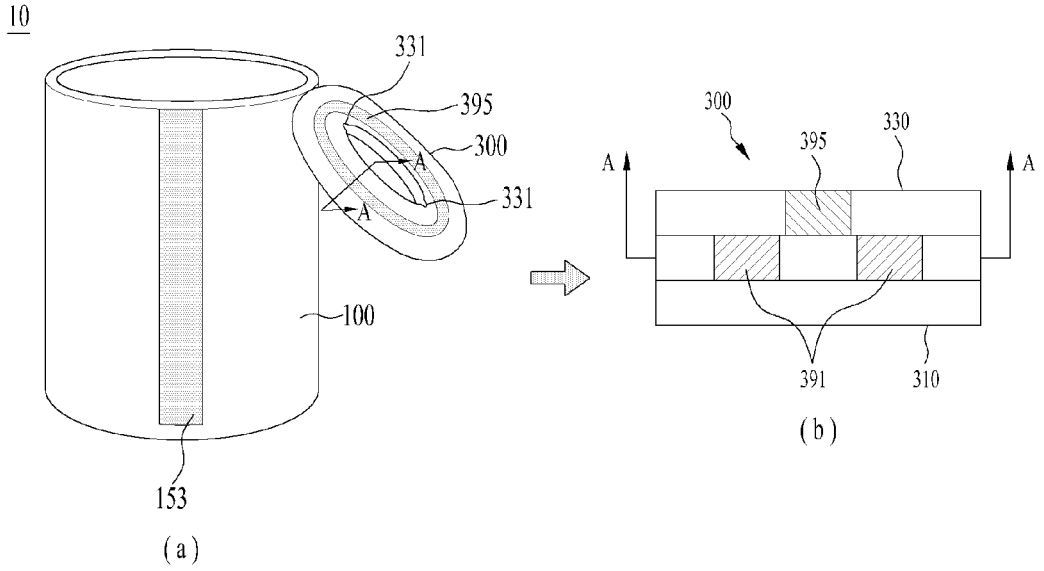

[FIG 6]
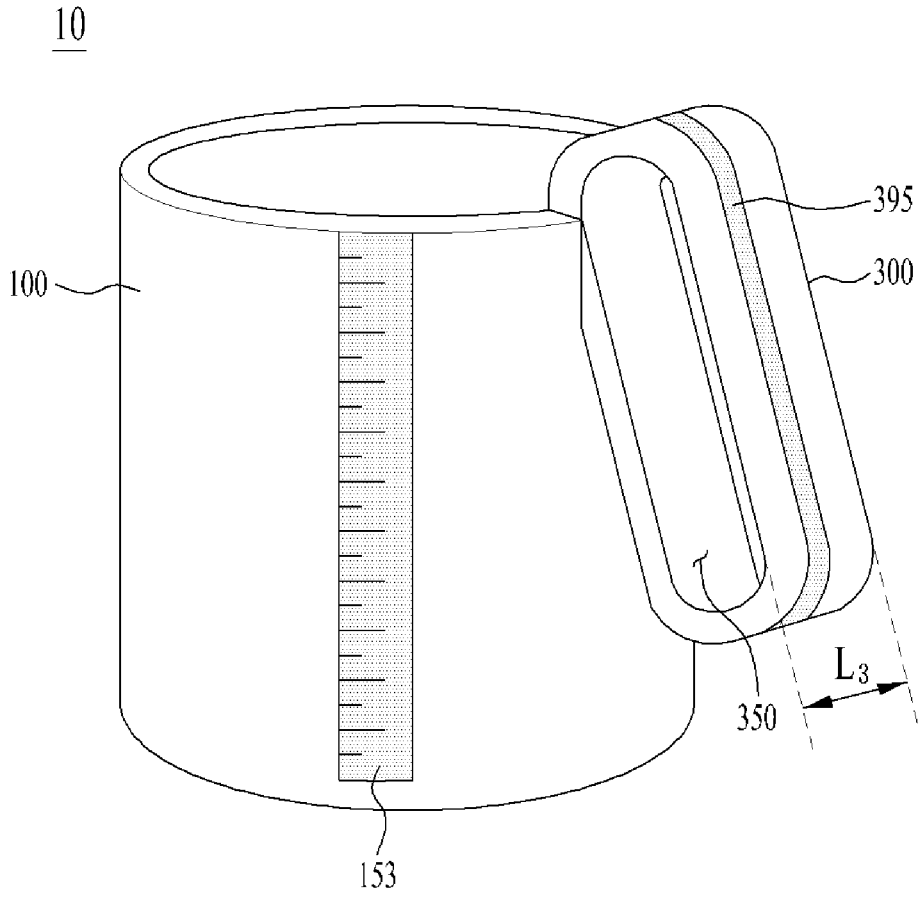

[FIG 7]
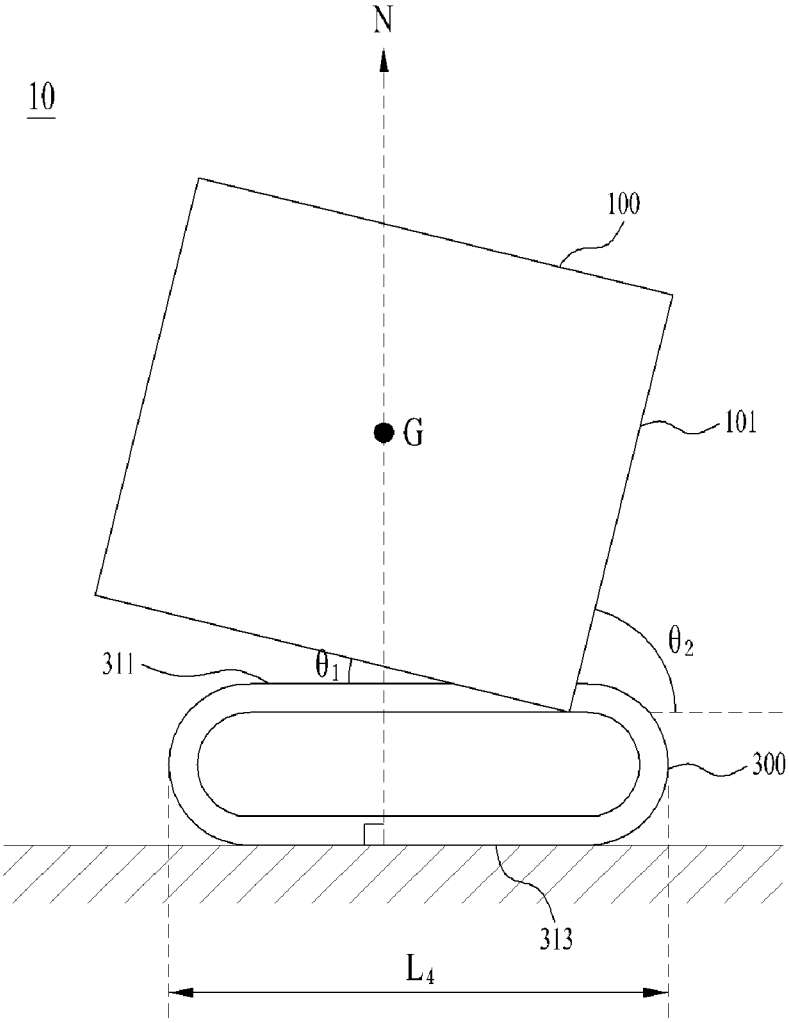

[FIG 8]
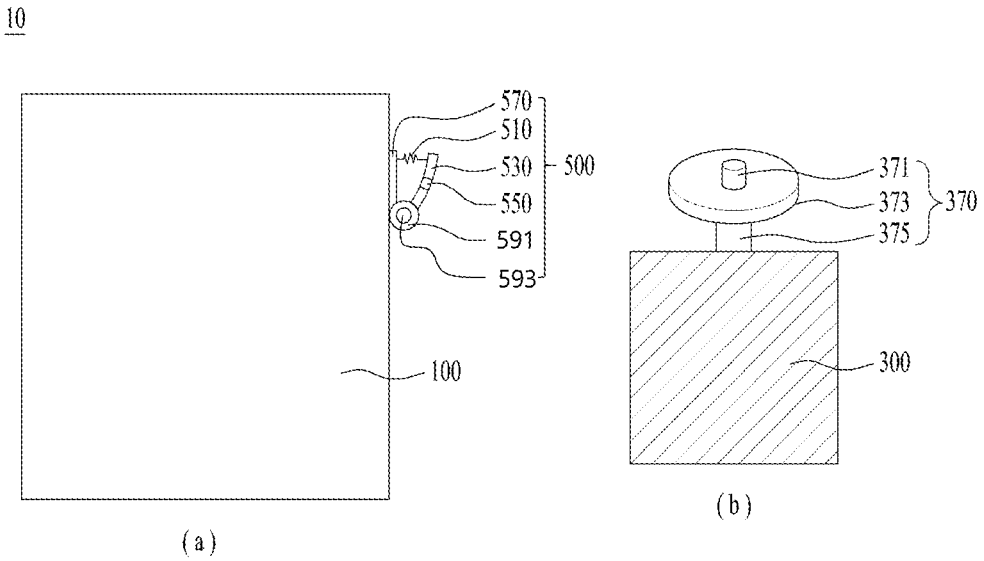

CUP

CROSS-REFERENCE TO RELATED APPLICATIONS

Pursuant to 35 U.S.C. § 119(a), this application claims priority to Korean Patent Application No. 10-2020-0061816 filed on May 22, 2020 in Korea, the entire contents of which is hereby incorporated by reference in its entirety.

BACKGROUND OF THE DISCLOSURE

Field of the Disclosure

Embodiments of the present disclosure relate to a cup that includes a handle part having an improved structure configured to discharge the moisture remaining therein.

Background of the Disclosure

A cup means a container formed in a size for being held in the hand with an open side to contain beverage.

A user usually washes and keep a conventional cup after turning the cup over after using so as to discharge the moisture remaining in the cup and prevent foreign substances from falling in the inside of the cup.

However, when keeping the cup after turning it over, an open side of the cup structured to contact with the user's lip will contact with the floor or table surface. In case the surface that contacts with the open side is unsanitary, the open side of the cup might be contaminated and unsanitary.

In addition, the inside of the cup is closed when kept after turned over and it is impossible for the inside to contact with externa air such that the moisture remaining in the cup may not be evaporated easily.

Accordingly, it becomes an important task to realize an efficient structure configured to discharge the moisture remaining in the cup after washing the cup and draw external air into the cup.

Meanwhile, the user may use a stirring stick to stir or drink the beverage contained in the cup.

However, the user may lay the stick over the inside of the conventional cup. In this instance, the user might feel uncomfortable with the stick laid over the inside of the cup when getting the cup to the lip to drink the beverage.

Also, when the used stick is laid distant from the cup, the beverage on the stick might contaminate an area near the stick and it might be unsanitary to re-use the stick in contact with the table surface or floor.

Accordingly, it becomes another important task to realize an efficient structure of a cup configured to keep the stick distant from the surface while the user is drinking the beverage after using or stirring the stick.

SUMMARY OF THE DISCLOSURE

Accordingly, an object of the present disclosure is to address the above-noted and other problems.

Another object of the present disclosure is to provide a cup having an open portion provided in a side of the cup and spaced a preset distance apart from a table surface or floor, when a user keeps the cup after turning it over.

A further object of the preset disclosure is to provide a cup having handle part portion provided to support a cup body to effectively discharge the moisture remaining in the inside of the cup.

A still further object of the present disclosure is to provide a cup having an extending portion that extends a preset distance along a circumference of a bottom surface of the cup.

A still further object of the present disclosure is to provide a cup having a handle part portion that includes a connection area to facilitate replacing the handle part portion.

A still further object of the present disclosure is to provide a cup having a handle part portion on which a user may lay the stirring stick when using the cup with stick.

A sill further object of the present disclosure is to provide a cup that may vibrate or generate a sound based on the temperature of the beverage contained therein.

A still further object of the present disclosure is to provide a cup having a handle part portion that may emit light when the user holds the handle part portion.

Embodiments of the present disclosure may provide a cup having an open portion provided in a side of the cup and spaced a preset distance apart from a table surface or floor, when a user keeps the cup after turning it over.

Embodiments of the present disclosure may provide a cup having handle part portion provided to support a cup body when a user keeps the cup after turning it over.

Embodiments of the present disclosure may provide a cup having an extending portion that extends a preset distance along a circumference of a bottom surface of the cup.

Embodiments of the present disclosure may provide a cup having a handle part portion that includes a connection area to facilitate replacing the handle part portion.

Embodiments of the present disclosure may provide a cup having a handle part portion on which a user may lay the stirring stick when using the cup with stick.

Embodiments of the present disclosure may provide a cup comprising a cup body comprising an opening and provided to contain a beverage; and a handle part provided in an outer surface of the cup body and configured to be holdable by a user.

The handle part may form a preset angle with respect to an outer surface of the cup body so that the cup body supported by handle part is spaced from a table surface or floor when the handle part in contact with the table surface or floor.

The length or width at which the handle part is formed is provided in a size such that when the handle part contacts with the table surface or floor, an imaginary normal extending from the table surface or floor to the center of gravity of the cup body to pass through the handle part.

The handle part may comprise a first surface that forms a preset angle with respect to an outer surface of the cup body and a bottom surface of the handle part; a second surface that faces the first surface and makes up a top surface of the handle part; and a through-hole that penetrates the first and second surfaces and allows the user to insert his finger therein.

The handle part may further comprise a receiving groove that is recessed from a predetermined area of an inner circumferential surface of the through-hole outwardly with respect to a radial direction of the through-hole.

The cup may further comprise a holding hole that penetrates both side surfaces of the handle and allows the user to hold the handle part.

The cup body may comprise an extension that downwardly extends along a circumference of the bottom surface of the cup body, and prevents the bottom surface of the cup body from contacting the table surface or floor; and a recess that is recessed a preset distance from a center of a bottom surface of the cup body.

The cup body may comprise a sensing part provided in an inner surface of the cup body and configured to measure the temperature of the beverage; a vibration part secured to the cup body and configured to vibrate the body part based on the temperature of the beverage; and a controller provided in the cup body and implemented to operate the vibration part based on a control signal transmitted by the sensing part.

The cup may further comprise a speaker provided in the outer surface of the cup body and configured to generate a sound based on the temperature of the beverage under the control of the controller.

The cup may further comprise a display part provided on the outer surface of the cup body and configured to display the height of the beverage.

The cup may further comprise a connection part provided between the cup body and the handle part and provided to connect the cup body and the handle part with each other.

The connection part may comprise a first connection body secured to an outer surface of the cup body; a second connection body connected with the first connection body from one side of the first connection body; and a connection hole that penetrates the second connection body and has the handle part coupled therein.

The handle part may further comprise a coupling portion that is protruded from one surface and inserted in the connection hole.

The connection part may further comprise an elastic member that is spaced apart from the connection hole and provides elasticity when the first connection body closely contacts with the second connection body by connecting the first and second connection bodies.

The handle part may comprise a piezoelectric element provided in the inside of the handle and configured to generate a power when a pressure is applied; a storage battery provided in the handle part and configured to store the power generated in the piezoelectric element; and a light emitting diode provided in one surface of the handle part and configured to receive the power stored in the storage battery and emit light.

The connection part may comprise a hinge part provided to connect the first connection body and the second connection body with each other.

The hinge part may comprise a first hinge member provided in a circular cylinder shape and coupled to the first connection body in one side of the first connection body.

The hinge part may comprise a second hinge member rotatably received in the first hinge member, and coupled to the second connection body.

The hinge part may comprise the first hinge member through which the second connection body to penetrate from one surface of the first hinge member facing the second hinge member.

According to the embodiment of the present disclosure, the present disclosure has the effect of providing a cup having an open portion provided in a side of the cup and spaced a preset distance apart from a table surface or floor, when a user keeps the cup after turning it over.

In addition, the present disclosure has the effect of providing a cup having handle part portion provided to support a cup body to effectively discharge the moisture remaining in the inside of the cup.

In addition, the present disclosure has the effect of providing a cup having an extending portion that extends a preset distance along a circumference of a bottom surface of the cup.

In addition, the present disclosure has the effect of providing a cup having a handle part portion that includes a connection area to facilitate replacing the handle part portion.

In addition, the present disclosure has the effect of providing a cup having a handle part portion on which a user may lay the stirring stick when using the cup with stick.

In addition, the present disclosure has the effect of providing a cup that may vibrate or generate a sound based on the temperature of the beverage contained therein.

In addition, the present disclosure has the effect of providing a cup having a handle part portion that may emit light when the user holds the handle part portion.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and reference numerals means structural elements and wherein:

FIG. 1 is a perspective diagram illustrating a cup according to one embodiment;

FIG. 2 is a diagram illustrating a cup including a display part and a handle part according to one embodiment, viewed from the outside;

FIG. 3 is a diagram illustrating a cup when the handle part contacts with the table surface or floor;

FIG. 4 is a diagram illustrating an inner cross section and a bottom surface of a cup body according to one embodiment;

FIG. 5 is a diagram illustrating an inner cross section of the handle part according to one embodiment;

FIG. 6 is a diagram illustrating another embodiment of the cup;

FIG. 7 is a diagram illustrating another embodiment of the handle part in case the handle part contacts with the surface or floor; and FIG. 8 is a diagram illustrating a connection portion and a coupling portion according to one embodiment.

DESCRIPTION OF SPECIFIC EMBODIMENTS

Hereinafter, referring to the accompanying drawings, exemplary embodiment of a compressor according to the present disclosure will be described. Regardless of numeral references, the same or equivalent components may be provided with the same reference numbers and description thereof will not be repeated. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Terms of respective elements used in the following description are terms defined taking into consideration of the functions obtained in the present invention. Therefore, these terms do not limit technical elements in the present invention. Further, the defined terms of the respective elements will be called other terms in the art. Terms such as "include" or "has" are used herein and should be understood that they are intended to indicate an existence of several components, functions or steps, disclosed in the specification, and it is also understood that greater or fewer components, functions, or steps may likewise be utilized.

It will be understood that although the terms first, second, etc. may be used herein to describe various elements, these elements should not be limited by these terms. These terms are generally only used to distinguish one element from another.

FIG. 1 is a perspective diagram illustrating a cup according to one embodiment. FIG. 2 is a diagram illustrating a cup including a display part 153 and a handle part 300 according to one embodiment, viewed from the outside.

FIG. 2 (*a*) is a diagram illustrating the cup 10 including the display part 153 and the handle part 300, viewed from in the opposite side of the display part 153. FIG. 2 (*b*) is a diagram illustrating the cup 10 including the handle part 300, viewed from the opposite side of the handle part 300.

As shown in FIGS. 1 and 2, the cup 10 according to one embodiment includes a cup body 100 and the handle part 300.

FIG. 1 illustrates an opening 101 provided in the cup body 100. The opening 101 may be provided in one side of the cup body 100. As shown in FIG. 1, the opening 101 may be provided in a top of the body 100 to open a top of the body 100.

In addition, a containing space may be formed in the cup body 100 to contain beverages. A user may contain a beverage in the cup body 100 through the opening 101 and drink the beverage once getting the lip to the opening 101.

A bottom of the cup body 100 that is provided in opposite to the opening 101 may not be open but closed.

As shown in FIG. 1, one end of the body 100 may be formed in a cylinder shape with one open end and the other end that form a circular cross section. Embodiments of the present disclosure are not limited thereto.

In other words, the body 100 may be formed in diverse shapes. However, to make the description easier, the cup body 100 may be formed in a shape having an almost circular cross section with the vertically extending length as shown in FIG. 1.

The vertical length of the cup body 100 may be 70 mm or more and 150 mm or less. When the cup body 100 extends vertically, the thickness of the cup body 100 as the length between an outer surface and an inner surface of the cup body 100 may be 25 mm or more and 45 mm or less.

The width where the body 100 is formed may be 50 mm or more and 110 or less. A bottom surface of the body inside and an inner surface of the cup body 100 may be curvedly connected with each other. A rotating radius of the curve may be approximately 2 mm or more and 4 mm or less.

Meanwhile, the cup 10 according to one embodiment may include the display part 153 provided in an outer surface of the body 100. As shown in FIGS. 1 and 2 (*a*), the display part 153 provided in the outer surface of the body 100 may be spaced apart from the handle part 300. The display part 153 may display part the height of the beverage contained in the cup body 100.

The display part 13 may be made of transparent plastic or glass. The inside of the cup body 100 may be visible through the display part 153 from the outside. Also, the display part 153 may include a display configured to display the height of the beverage that is measured by a sensing part 131 which will be described later on a screen.

The user may visually identify a degree of the beverage from the outside and intuitively check presence of the beverage contained in the cup body 100, not through the top of the body 100.

Meanwhile, as shown in FIG. 1, the cup according to one embodiment may include the handle part 300 provided in the outer surface of the cup body 100 and holdable by the user. The handle part 300 may extend from the outer surface of the cup body 100.

FIGS. 1 and 2 (*a*) illustrates the handle part 300 extending from the cup body 100 and forming a preset angle from the outer surface of the cup body 100.

As shown in FIGS. 1 and 2 (*a*), the handle part 300 may extend from one surface that is located closet to one end of the outer surface in which the opening 101 is provided. The handle part 300 may form a preset angle θ1 with respect to the outer surface of the cup body 100.

The angle θ1 may be preset to allow the handle part 300 to support the cup body 100, which will be described in detail later, and have a value of more than 0° and 90° or less.

The handle part 300 may include a first surface 311 forming a preset angle θ1 with respect to the outer surface of the body 100 and defining a lower surface of the handle part; and a second surface 313 facing the first surface 311 and defining an upper surface of the handle part.

The first surface 311 may be spaced apart from the cup body 100 and corresponding to one surface of the handle part 300 that is located close to the outer surface of the body 100.

In addition, the second surface 313 may face the first surface 311 in parallel. A distance between the first and second surfaces 311 and 313 may be equal to the thickness of the handle part 300. Specifically, the thickness of the handle part 300, in other words, the distance between the first and second surfaces may be 10 mm or more and 200 mm or less.

Meanwhile, the handle part 300 may include a through-hole 330 provided through the first surface 311 and the second surface 313 to insert the user's finger therein. The width W2 of the through-hole 330 may be larger than the user's thumb and approximately 25 mm or more and 45 mm or less.

In addition, the largest width W1 of the handle part 300 may be smaller than the width or diameter of the cup body 100. The width of the handle part 300 may be large enough for the user to insert the thumb in the through-hole 330 and hold the cup body 100 in the other fingers. In other words, the largest width W1 of the handle part 300 may be 50 mm or more and 70 mm or less.

As shown in FIGS. 1 and 2 (*b*), the handle part 300 may be formed in a ring shape having a circular cross section area but embodiments of the present disclosure are not limited thereto. Any shapes may be applicable to the handle only if allowing the user to insert the finger.

Hereinafter, the shape of the handle part 300 may be the ring having a circular cross section area to make the description easier.

Also, the handle part 300 may include a receiving groove 331 recessed from some area of an inner circumferential surface of the through-hole outwardly in a radial direction of the through-hole 330. At least one receiving groove 331 may be provided in the inner circumferential surface of the through-hole 330.

The recessed length of the receiving groove 331 may be smaller than a distance between the inner circumferential surface of the through-hole 330 and a piezoelectric element 391 or a light emitting diode 395 which will be described later, to locate the handle distant enough from the piezoelectric element and light emitting diode.

When the using a stirring stick to stir or use like a spoon, the user may lay the stick on the handle part 300. In this instance, the receiving groove 331 may accommodate the stick or the like to facilitate the effective laying of the stick on the handle part 300.

As the stick is laid on the handle part 300, the user may continuously use the stick sanitarily even without putting the used stick on a table surface or floor.

FIG. 3 is a diagram illustrating a cup when the handle part contacts with the table surface or floor.

Hereinafter, a different structure from the above-noted structure configured to provide the handle part in contact with the table surface will be described in detail so as to avoid repeated description.

The cup 10 according to one embodiment may include the cup body 100 having the opening 101 formed therein and containing the beverage; and the handle part 300 provided in the outer surface of the cup body 100 and holdable by the user.

As mentioned above, the handle part 300 may form the preset angle θ1 with respect to the outer surface of the cup body 100. The angle θ1 may be preset to locate the cup body 100 distant from the table surface, when the handle part 300 contacts with the table surface.

The length L1 or width W2 (see FIG. 2 (*b*)) of the handle part 300 may be large enough for an imaginary normal N extending from the table surface to a gravity center G of the cup body 100 to pass through the handle part 200.

The gravity center G of the cup body 100 means a spot at which a proper torque generated by the gravity that is applied to the cup body 100 becomes zero. In other words, a free spot of the cup body 100 may be defined as locations Xi, Yi, Zi on Cartesian coordinates. In this instance, the location of the gravity center G may be defined as $$\frac{\sum m_i x_i}{\sum m_i} \frac{\sum m_i y_i}{\sum m_i} \frac{\sum m_i z_i}{\sum m_i} \text{(mi refers to mass on a free location).}$$

When the second surface 313 of the handle part 300 contacts with the table surface, a normal line N extending from the table surface to the gravity center G of the cup body 100 may pass through the second surface 313 of the handle part 300 to allow the handle part 300 to support the cup body 100.

The length L1 or width W1 of the handle part 300 may be determined as a sufficient value to make the normal line N to pass through the second surface 313. Also, as mentioned above, the angle θ1 between the handle 300 and the cup body 100 may be also determined as a sufficient value.

The angle θ2 between the opening 101 of the cup body 100 and the table surface may be variable based on the angle θ1 of the handle part 300 and the shape of the cup body 100. When the cross-section area of the cup body 100 is formed in a cylinder shape as shown in FIG. 3, the angle θ2 may be determined as 90° that is the size of the angle θ1.

When the handle part 300 contacts with the table surface or floor, the cup body 100 may be supported by the handle part 300 and the opening 101 of the cup 10 after the washing may be spaced apart from the table surface such that the moisture remaining in the cup 10 can be discharged outside and external air may be drawn into the cup 10.

FIG. 4 is a diagram illustrating an inner cross section and a bottom surface of the cup body 100 according to one embodiment.

FIG. 4 (*a*) is a sectional diagram illustrating the inside of the cup body 100 according to one embodiment. FIG. 4 (*b*) is a diagram illustrating the bottom surface of the cup body 100, viewed from the ground. Hereinafter, a different structure from the above-noted structure will be described in detail to avoid repeated description.

As mentioned above, the cup body 100 may include the opening 101 provided in a top of the cup body 100 and formed to open the top of the cup body 100 (see FIG. 1).

A containing space may be formed in the cup body 100 to contain a beverage. The user may store the beverage in the cup body 100 through the opening 101 or and drink the beverage once getting the lip to the opening 101. A bottom of the cup body 100 that is provided in opposite to the opening 101 may not be open but closed.

Meanwhile, as shown in FIGS. 4 (*a*) and 4 (*b*), the cup body 100 may include an extension 111 extending towards the lower portion of the cup body 100 along a circumference of the bottom surface of the cup body 100 and provided to prevent the bottom surface of the cup body 100 from contacting with the table surface.

The extension 111 may extends towards the lower portion of the cup body 100 along a circumference of the bottom surface of the cup body 100 such that a diameter of an outer circumferential surface of the extension 111 may be equal to a diameter of the cup body 100.

As the extension 111 is provided in the bottom surface of the cup body 100, a contact area between the cup body 100 and the table surface may be decreased. Accordingly, the amount of the heat transfer conducted from the cup body 100 to the table surface may be decreased.

In addition, as the heat transfer amount conducted to the table surface is decreased, the heat transfer amount conducted to the cup body 100 from the beverage contained in the cup may be also decreased.

In addition, as the extension 111 is provided, the contact area between the cup body 100 and the table surface may be decreased and a friction force acting between the cup body 100 and the table surface may become large. As the friction force increases, the cup body 100 may be prevented from sliding on the table surface.

In addition, the extending length of the extension 111 may be approximately 2 mm or more and 4 mm or less from the bottom surface of the cup body 100. A diameter of an inner circumferential surface of the extension 111 may be 2 mm or more and 5 mm or less, which is smaller than a diameter of the outer circumferential surface of the cup body 100.

Meanwhile, the cup 10 according to one embodiment may include a recess 113 recessed a preset distance from the center of the bottom surface of the body 100. As the recess 113 is provided, a company logo may be attached on one surface of the recess 113 and the user's identification mark may be written on one surface.

When the user keeps the cup 10 that is turned over as mentioned above, a third person looking at the cup 10 may identify the logo attached to the recess 113. The recess 113 may give the user an advertising effect for the third person and an aesthetic sense.

In addition, the recessed length of the recess 113 may be 0.5 mm or more and 1.5 mm or less, which is smaller than the thickness of the bottom surface of the cup body 100.

Meanwhile, the cup body 100 may include a sensing part 131 and a controller 135. The cup body 100 may include a speaker 151 as mentioned above.

The sensing part 131 may be provided in an inner surface of the cup body 100 and configured to measure the temperature of the beverage contained in the cup body 100. Also, the controller 135 may be provided in the cup body 100 and operate the vibration part 133 or the speaker 151 based on a control signal transmitted by the sensing part 131.

As shown in FIG. 4 (*a*), the sensing part 131 may be provided in a lower center of the inner surface of the body 100. The sensing part 131 may convert the sensed temperature of the beverage into an electrical signal to the controller 135.

Although not shown in FIG. 4 (*a*), a waterproof layer may be provided on an outer surface of the sensing part 131 to prevent the beverage from permeating through the sensing part 131.

Meanwhile, the vibration part 133 may be provided in a lower area of the cup body 100 and formed in a ring shape having a circular cross section area with an opening. The thickness of the vibration part 133 may be smaller than that of the bottom surface of the cup body 100. The strength of the vibration generated by the vibration part 133 may be strong enough to allow the user holding the cup body 100 to sense the vibration.

Also, the speaker 151 may be provided in an outer circumferential surface of the cup body 100. The strength of the sound generated by the speaker 151 has to be strong enough to allow the user to sense the sound when the user is located close to the cup body 100 to hold the cup body 100.

The controller 135 may be implemented to operate the vibration part 133 or the speaker 151 based on the control signal transmitted by the sensing part 131. Specifically, when the temperature of the beverage transmitted by the sensing unit 131 falls to a first temperature or less, the controller 135 may be implemented to operate the vibration part 133 or the speaker 151.

As one example, the first temperature may be preset not to cause discomfort like a mouse burn or tongue burn when the user drinks coffee or the like (e.g., 75° C.).

As the vibration part 133 or the speaker 151 is operated based on the preset temperature, the user may escape from the danger of the burn caused when the user drinks a high-temperature beverage. The user may sense the sound generated by the speaker 151 and drink the beverage safely.

Meanwhile, although not shown in FIG. 4 (*a*), a USB port to which a power supply unit is coupled may be provided in the outer surface of the cup body 100 to supply a power to the controller 135.

FIG. 5 is a sectional diagram illustrating the inside of the handle part according to one embodiment. Hereinafter, a different structure from the above-noted structure will be described in detail to avoid repeated description.

As shown in FIG. 5 (*a*), the handle part 300 may include a piezoelectric element 391, a storage battery 393 and a light emitting diode 395. The light emitting diode 395 may be provided in the inside of the handle part 300 and face the second surface 313.

In addition, a diameter of the light emitting diode 395 may be smaller than a diameter of the handle part 300 and the light emitting diode 395 may have a different color from the handle part 300.

FIG. 5 (*b*) illustrates a cross sectional area of the handle part 300 shown in FIG. 5 (*a*).

A plurality of light emitting diodes 395 may be provided in the second surface 313 to emit light towards the second surface 313. As one example, the light emitting diodes 395 may be a chip LED having a plurality of LEDs mounted therein to achieve preset brightness by using the minimum number of the LEDs. In other words, the light intensity of the chip LED may be multiplied, because a plurality of LEDs may be arranged in one module.

Meanwhile, the piezoelectric element 391 may be provided in the handle part 300 to generate the power when a pressure is applied therein. The piezoelectric element 391 may be provided between the first surface 311 and the second surface 313.

The piezoelectric element 391 may be configured to generate electricity based on a piezoelectric effect. According to the piezoelectric effect, the pressure is applied to a preset crystal in one direction and a positive charge and a negative charge may be then formed in proportion to an external force of the first and second surfaces 311 and 313.

Specifically, a mechanical energy may be converted into an electrical energy by the piezoelectrical effect. When the user applies the pressure to the handle part 300 while holding the first and second surfaces 311 and 313, the piezoelectric element 391 provided in the cup according to one embodiment may generate the electric energy based on the piezoelectric effect.

The piezoelectric element 391 may be a piezoelectric plate in which a plurality of piezoelectric elements is electrically connected with each other.

Although not shown in FIG. 5 (*b*), the handle part 300 may include the storage battery 393 configured to store the electric power generated in the piezoelectric element 391.

The light emitting diode 395, the storage battery 393 and the piezoelectric element 391 may be arranged between the first surface 311 and the second surface 313 and electrically connected with each other. The piezoelectric element 391 may be connected serially or parallelly. The storage battery 393 may store the electric energy generated in the piezoelectric element 140. The electric energy stored in the storage battery 393 may be used in driving the light emitting diode 395.

As one example, when the user holds the handle part 300, the electric power generated by the piezoelectric element 391 may be stored in the storage battery 393 and the power stored in the storage battery may emit light from the light emitting diode 395.

Accordingly, the user may get the aesthetic effect that light is emitted from the handle part 300 when the user holds the handle part 300.

FIG. 6 is a diagram illustrating another embodiment of the cup 10. FIG. 7 is a diagram illustrating another embodiment of the handle part in case the handle part contacts with the surface or floor. Hereinafter, a different structure from the above-noted structure configured to provide the handle part in contact with the table surface will be described in detail so as to avoid repeated description.

As shown in FIGS. 6 and 7, the cup 10 according to one embodiment may include a cup body 100 and the handle part 300.

FIG. 6 illustrates an opening 101 provided in the cup body 100. The opening 101 may be provided in one side of the cup body 100. As shown in FIG. 1, the opening 101 may be provided in a top of the body 100 to open a top of the body 100.

In addition, a containing space may be formed in the cup body 100 to contain beverages. As shown in FIGS. 6 and 7, one end of the body 100 may be formed in a cylinder shape with one open end and the other end that form a circular cross section. Embodiments of the present disclosure are not limited thereto.

In other words, the body 100 may be formed in diverse shapes. However, to make the description easier, the cup body 100 may be formed in a shape having an almost circular cross section with the vertically extending length as shown in FIG. 6.

Meanwhile, the cup 10 according to one embodiment may include the display part 153 provided in an outer surface of the body 100. As shown in FIGS. 6 and 7 (*a*), the display part 153 provided in the outer surface of the body 100 may be spaced apart from the handle part 300. The display part 153 may display part the height of the beverage contained in the cup body 100.

Meanwhile, as shown in FIG. 6, the cup according to one embodiment may include the handle part 300 provided in the outer surface of the cup body 100 and holdable by the user.

The handle part 300 may extend from the outer surface of the cup body 100. FIGS. 6 and 7 illustrates the handle part 300 extending from the cup body 100 and forming a preset angle from the outer surface of the cup body 100.

As shown in FIG. 6, the handle part 300 may extend from one surface that is located close to one end of the outer surface in which the opening 101 is provided. As shown in FIG. 7, the handle part 300 may form a preset angle θ1 with respect to the outer surface of the cup body 100.

The angle θ1 may be preset to allow the handle part 300 to support the cup body 100, which will be described in detail later, and have a value of more than 0° and 90° or less.

The handle part 300 may include a first surface 311 forming a preset angle θ1 with respect to the outer surface of the body 100 and defining a lower surface of the handle part; and a second surface 313 facing the first surface 311 and defining an upper surface of the handle part.

The first surface 311 may be spaced apart from the cup body 100 and corresponding to one surface of the handle part 300 that is located close to the outer surface of the body 100. The second surface 313 may be formed in parallel with the first surface. An extended line passing through the center of the second surface 313 in parallel with the second surface 313 may not pass through the cup body 100.

Specifically, as shown in FIG. 6, one end of the handle part 300 may be higher than the opening 101 of the cup body with respect to the table surface.

Meanwhile, the handle part 300 may include a holding hole 350 formed through both sides of the handle part 300 to allow the user to hold the handle part 300. More specifically, the side surfaces of the handle part 300 may become a third or fourth surface that vertically extending with respect to an axial direction of the extended handle part 300 from the first and second surfaces 311 and 313.

The holding hole 350 may be provided in the handle part 300 to pass through the third and fourth surfaces, with an oval cross-sectional area. As shown in FIG. 7, the length of the long axis of the cross-section area along the holding hole 350 is smaller than the thickness of the handle part 300 with respect to the extended length L4 from one surface of the cup body 100 as much as twice.

The length of a short axis along a cross section area of the holding hole 350 may be equal to or smaller than the width L3 of the first surface 31 and the second surface 313.

As the holding hold 350 is provided in the side surfaces of the handle part 300, the user may insert the other fingers in the holding hole 350 except the thumb and hold the handle part 300, different from the cup 10 having the through-hole 330. In other words, the area of the cross section along the holding hole 350 may be large enough to insert the user's fingers.

As the holding hole 350 is provided, the user may hold the cup 10 with the hand only by holding the handle part 300, without contacting with the cup body 100. In addition, as the user inserts the other fingers except the thumb in the holding hole 350, the user may hold the user's cellphone with the thumb and palm not inserted, while holding the handle part 300.

As shown in FIGS. 6 and 7, the both side surfaces of the handle may have an oval-shaped cross section and a ring shape in which the holding hole 350 is provided. However, the embodiments of the present disclosure are not limited thereto and any shapes may be applicable only if the user is able to insert the finger in the holding hole 350.

Here, for easy understanding, the shape of the handle part 300 may have the side surface that has the oval-shaped cross section area and the ring shape in which the holding hole 350 is provided.

As mentioned above, FIG. 7 illustrates the handle part 300 provided to form a preset angle θ1 with respect to the outer surface of the cup body 100. The angle θ1 may be preset to locate the cup body 100 distant from the table surface, when the handle part 300 contacts with the table surface.

The length L4 or width L3 (see FIG. 6) of the handle part 300 may be large enough for an imaginary normal N extending from the table surface to a gravity center G of the cup body 100 to pass through the handle part 200.

The gravity center G of the cup body 100 means a spot at which a proper torque generated by the gravity that is applied to the cup body 100 becomes zero. In other words, a free spot of the cup body 100 may be defined as locations Xi, Yi, Zi on Cartesian coordinates. In this instance, the location of the gravity center G may be defined as $$\frac{\sum m_i x_i}{\sum m_i} \frac{\sum m_i y_i}{\sum m_i} \frac{\sum m_i z_i}{\sum m_i}$$ (mi refers to mass on a free location).

When the second surface 313 of the handle part 300 contacts with the table surface, a normal line N extending from the table surface to the gravity center G of the cup body 100 may pass through the second surface 313 of the handle part 300 to allow the handle part 300 to support the cup body 100.

The length L4 or width L3 of the handle part 300 may be determined as a sufficient value to make the normal line N to pass through the second surface 313 Also, as mentioned above, the angle θ1 between the handle 300 and the cup body 100 may be also determined as a sufficient value.

When the handle part 300 contacts with the table surface or floor, the cup body 100 may be supported by the handle part 300 and the opening 101 of the cup 10 after the washing may be spaced apart from the table surface such that the moisture remaining in the cup 10 can be discharged outside and external air may be drawn into the cup 10.

FIG. 8 is a diagram illustrating a connection part 500 and a coupling portion 370 of the cup 10 according to one embodiment of the present disclosure. Hereinafter, a different structure from the above-noted structure will be described in detail to avoid repeated description.

FIG. 8 (*a*) illustrating the connection part 500 coupled to one surface of the cup body 100 according to one embodiment.

The connection part 500 may be provided between the cup body 100 and the handle part and coupled to one surface of the cup body 100. The connection part 500 may be configured to couple the cup body 100 to the handle part 300.

In addition, the connection part 500 may include a first connection body fixed to the outer surface of the cup body 100. The first connection body 510 may be secured to the outer surface of the body 100 by using a screw and a bolt or welding.

The first connection body 510 may be coupled to the outer surface of the body 100 by using an adhesive disposed between them.

The width of the first connection body 510 extending in parallel with the table surface or floor may be equal to or smaller than the width of the handle part 300

Meanwhile, the connection part 500 may include a second connection body 530 connected from one side of the first connection body 510 to the first connection body 510. Specifically, the second connection body may extend from one side of the first connection body along the opposite direction with respect to the floor, while being connected with the first connection body 510.

The second connection body 530 may be equal to the first connection body 510 in the length, the width and the thickness.

Also, the connection part 500 may include a hinge part 590 provided to connect the first connection body 510 and the second connection part 530 with each other. The hinge part 590 may include a first hinge member 591 coupled to the first connection body 510. The first hinge member 591 may be integrally coupled to the first connection body 510 as one body.

The first hinge member 591 may be formed in a cylinder shape with a circular cross section area. A second hinge member 593 may be accommodated by the center of the first hinge member 591. The second hinge member may be rotatably coupled to the center of the first hinge member. The second connection body 530 may penetrate the first hinge member in one surface where the first hinge member 591 faces the second hinge member 593.

The second hinge member 593 may be integrally coupled to the second connection body 530 as one body. The second hinge member 593 may be accommodated by the inside of the first hinge member 591 and the first and second hinge members may contact with each other to be rotatable.

In addition, the connection part 500 may include a connection hole 550 formed through the second connection body 530 to couple the handle part 500 thereto. The connection hold 550 may be provided between the cup body 100 and the handle part 300.

The connection part may penetrate the other surface provided in opposite to one surface of the connection body vertically with respect to the extension direction of the second connection body. Also, it may have a diameter that is large enough to insert the coupling portion 370 therein which will be described later.

In addition, the connection part 500 may include an elastic member 570 spaced apart from the connection hole 550 and providing elasticity to the first and second connection bodies 510 and 530 when the first and second connection bodies 510 and 530 are in close contact with each other after connected with each other.

When the coupling portion 370 is coupled to the connection part 500, the flexible member 570 may provide the second connection body 530 with the elasticity used in supporting the coupling portion 370. When one surface of the coupling portion 370 contacts with the first connection body, the flexible member 570 may decouple the coupling portion 370 from the cup body 100.

Specifically, the handle part 300 may include the coupling portion 370 protruding from one surface of the handle part 300 and inserted in the connection hole 550.

The coupling portion 370 may include a third coupling member 375 protruding from one surface of the handle part 300 and connected with the handle part 300. Also, the coupling portion 370 may include a second coupling member 373 located between the first and second connection bodies 510 and 530 when the third coupling member 375 extending from the other surface in opposite to one surface connected with the handle part 300 and coupled to the connection part 500.

In addition, the coupling portion 370 may include a first coupling member 371 supporting the coupling portion 370 by contact with the first connection body 510 when protruding from the other surface in opposite to one surface in which the second coupling member 373 is connected with the third coupling member 375 and the coupling portion 370 is coupled to the connection part 500.

The first coupling member 371 and the third coupling member 375 may have the same diameter with the connection hole 550. The second coupling member 373 may have a larger diameter than the connection hole 550. However, the second coupling member 373 may be made of a flexible material that may penetrate the connection hole 550.

More specifically, when the coupling portion 370 is coupled to the connection part 500, one surface of the first coupling member may contact with the first coupling member 371 and the second coupling member 373 may be provided between the first connection body 510 and the second connection body 530 to contact with one surface of the second connection body 530.

An inner circumferential surface of the connection hole 550 may be provided in contact with an outer circumferential surface of the third coupling member 375. Also, it may contact with the handle part 300 in the other surface facing one surface in which the second connection body 530 contacts with the second coupling member 373.

As the coupling portion 370 is provided, the user may decouple the coupling portion 370 from the connection part 500, when pressing the second connection body 530 towards the cup body 100. In addition, the user may couple the coupling portion 370 to the connection part 500 again.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A cup comprising:

a cup body comprising an opening and provided to contain a beverage; and a handle part provided in an outer surface of the cup body and configured to be holdable by a user, wherein the handle part forms a preset angle with respect to an outer surface of the cup body so that the cup body supported by handle part is spaced from a table surface or floor when the handle part in contact with the table surface or floor;

a holding hole that penetrates both side surfaces of the handle part and allows the user to hold the handle part;

an extension that downwardly extends along a circumference of a bottom surface of the cup body, and preventing the bottom surface of the cup body from contacting the table surface or floor; and a recess that is recessed a preset distance from a center of the bottom surface of the cup body, wherein a length or width at which the handle part is formed is provided in a size such that when the handle part contacts with the table surface or floor, an imaginary normal extending from the table surface or floor to a center of gravity of the cup body to pass through the handle part.

2. The cup of claim 1, wherein the handle part comprises:

a first surface that forms a preset angle with respect to an outer surface of the cup body and a bottom surface of the handle part;

a second surface that faces the first surface and makes up a top surface of the handle part; and a through-hole that penetrates the first and second surfaces and allows the user to insert his finger therein.

3. The cup of claim 2, wherein the handle part comprises a receiving groove that is recessed from a predetermined area of an inner circumferential surface of the through-hole outwardly with respect to a radial direction of the through-hole.

4. The cup of claim 3, wherein the cup body comprises an extension that downwardly extends along a circumference of the bottom surface of the cup body, and prevents the bottom surface of the cup body from contacting the table surface or floor; and a recess that is recessed a preset distance from a center of a bottom surface of the cup body.

5. The cup of claim 4, wherein the cup body comprises:

a sensing part provided in an inner surface of the cup body and configured to measure the temperature of the beverage;

a vibration part secured to the cup body and configured to vibrate the body part based on the temperature of the beverage; and a controller provided in the cup body and implemented to operate the vibration part based on a control signal transmitted by the sensing part.

6. The cup of claim 5, further comprising a speaker provided in the outer surface of the cup body and configured to generate a sound based on the temperature of the beverage under the control of the controller.

7. The cup of claim 6, further comprising a display part provided on the outer surface of the cup body and configured to display the height of the beverage.

8. The cup of claim 7, further comprising a connection part provided between the cup body and the handle part and provided to connect the cup body and the handle part with each other, wherein the connection part comprises:

a first connection body secured to an outer surface of the cup body;

a second connection body connected with the first connection body from one side of the first connection body; and a connection hole that penetrates the second connection body and has the handle part coupled therein, and the handle part comprising a coupling portion that is protruded from one surface and inserted in the connection hole.

9. The cup of claim 8, wherein the connection part further comprises an elastic member that is spaced apart from the connection hole and provides elasticity when the first connection body closely contacts with the second connection body by connecting the first and second connection bodies.

10. The cup of claim 9, wherein the handle part comprises:

a piezoelectric element provided in the inside of the handle part and configured to generate a power when a pressure is applied;

a storage battery provided in the inside of the handle part and configured to store the power generated in the piezoelectric element; and a light emitting diode provided in one surface of the handle part and configured to receive the power stored in the storage battery and emit light.

11. The cup of claim 10, wherein the connection part comprises a hinge part provided to connect the first connection body and the second connection body with each other.

12. The cup of claim 11, wherein the hinge part comprises a first hinge member provided in a circular cylinder shape and coupled to the first connection body in one side of the first connection body.

13. The cup of claim 12, wherein the hinge part comprises a second hinge member rotatably received in the first hinge member, and coupled to the second connection body.

* * * * *